United States Patent [19]

Winther

[11] 4,064,579

[45] Dec. 27, 1977

[54] WATERBED MATTRESS WITH INFLATABLE MARGINS

[75] Inventor: Howard Allyn Winther, Santa Clara, Calif.

[73] Assignee: Liberty Vinyl Corporation, Santa Clara, Calif.

[21] Appl. No.: 713,563

[22] Filed: Aug. 11, 1976

[51] Int. Cl.[2] ..... A67C 27/08

[52] U.S. Cl. ..... 5/371

[58] Field of Search ..... 5/365, 368, 369, 370, 5/371, 338, 341

[56] References Cited

U.S. PATENT DOCUMENTS

| | | | |
|---|---|---|---|
| 2,691,179 | 10/1954 | Kann | 5/368 |
| 3,864,768 | 2/1975 | Fraige et al. | 5/371 |
| 3,918,110 | 11/1975 | Cantillo et al. | 5/371 |
| 3,925,835 | 12/1975 | Pennington et al. | 5/371 |

*Primary Examiner*—Paul R. Gilliam
*Assistant Examiner*—Kenneth J. Dorner
*Attorney, Agent, or Firm*—Townsend and Townsend

[57] ABSTRACT

A waterbed mattress adapted to fit within a rigid frame comprises a water-containing main chamber and at least one supplemental chamber along the perimeter of the main chamber for containing a fluid giving structural rigidity to the perimeter, particularly along the upper boundary abutting the frame. The supplemental chamber is established by an imperforate flexible membrane internally spanning the mattress corner between the top panel and the adjacent side panel. The cross sectional length of the membrane is not greater than the dimension of the adjacent top and side panel segments which constitute the outer walls of the chamber.

8 Claims, 4 Drawing Figures

WATERBED MATTRESS WITH INFLATABLE MARGINS

BACKGROUND OF THE INVENTION

1. Field of Invention.

This invention relates to a waterbed mattress, and particularly to a waterbed mattress having multiple chambers useful for maintaining structural integrity of the mattress within a supporting frame.

Waterbeds have been long known for use in hospitals to prevent bed sores and to relieve burn victims. Moreover, waterbeds have in recent years attained general popularity. A waterbed will uniformly and comfortably support a person in a reclining position thereon. However, if a person ventures too close to the mattress perimeter, particularly if weight is concentrated at or near an edge abutting a support frame panel, the localized liquid tends to displace forming a depression. As a result, a portion of the body may be caught between the frame panel and mattress side panel, which could cause discomfort and result in possible injury.

2. Description of the Prior Art.

Waterbed mattresses are known which utilize inflated air beam structure for rigidity and support. U.S. Pat. No. 3,766,579 to Shields, discloses a waterbed incorporating a selectively inflatable air structure. In the Shields patent, a waterbed mattress is described having an integral air frame about the periphery of the mattress wherein a water envelope is contained generally within the borders of an air filled frame. So far as could be determined, the patent does not suggest the use of a water and air filled mattress within a rigid frame, and therefore does not address the particular problems posed by a frame-enclosed mattress.

U.S. Pat. No. 3,864,768 to Fraige et al. describes a waterbed mattress adapted to be confined within a rigid box-like framework which comprises a water-inflatable bag-like enclosure and a float hingedly connected internally of the bag-like enclosure along one edge panel. The degree of support provided the upper edge of the water-filled mattress is apparently determined by the degree of inflation of the internal float tube which is buoyantly urged into the upper mattress corner. The float tube is an internal element or appendage separate from the the enclosure which merely floats in the liquid. In order to be operative as disclosed it necessarily must be filled with a gas such as air.

SUMMARY OF THE INVENTION

A waterbed mattress according to the present invention is adapted to fit within a rigid frame and to maintain selected structural rigidity along the perimeter. The mattress comprises a water-containing main chamber and at least one supplemental chamber along the perimeter of the main chamber for containing a fluid giving structural rigidity to the periphery, particularly along the upper boundary confronting the frame enclosing the mattress. The supplemental chamber is established by an imperforate membrane internally spanning the mattress corner between the top panel and the adjacent side panel. The cross sectional length of the membrane between the top and side is not greater than the dimension of the adjacent top and side panel segments which constitute the outer walls of the supplemental chamber and mattress perimeter.

In further preferred embodiments, the cross sectional length or corner spanning dimension of the membrane approximates the length of the hypotenuse of the right triangle formed in cross section whose legs are the top and side panel segments. A further embodiment includes both an upper corner chamber and a lower corner chamber formed by imperforate flexible membranes spanning the respective upper and lower corners, which provides additional vertical rigidity.

BRIEF DESCRIPTION OF THE DRAWINGS

The invention may be best understood by reference to the following detailed description taken in conjunction with the following figures in which.

DETAILED DESCRIPTION OF PREFERRED EMBODIMENTS

Figure 1:
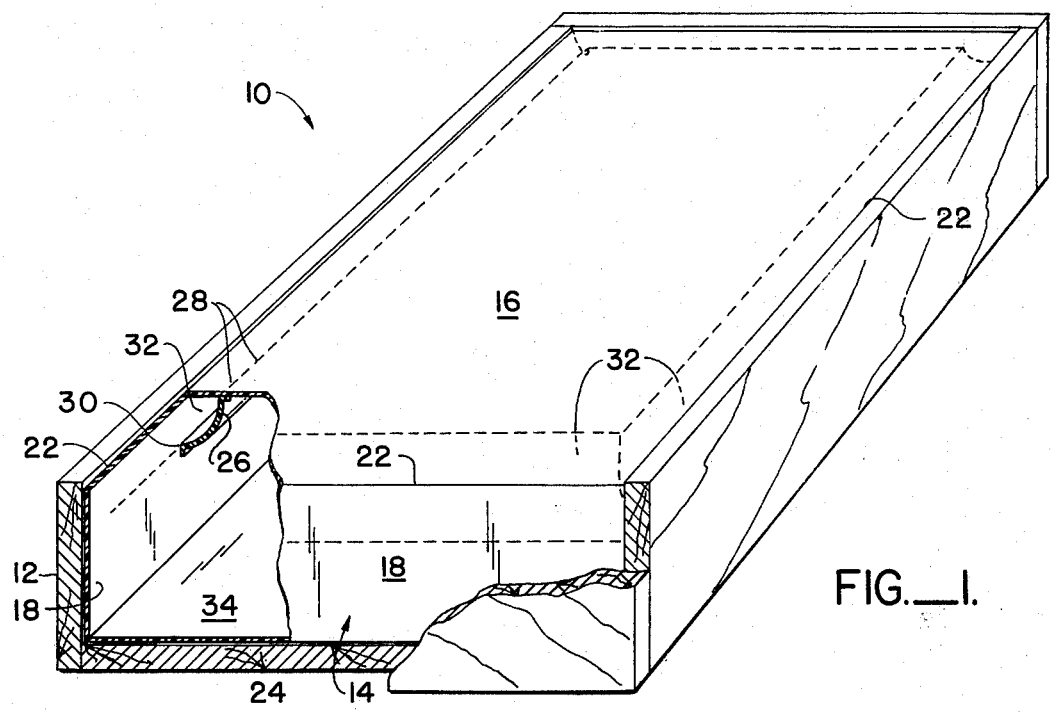
FIG. 1 is a perspective view of the water mattress and frame and showing in partial cutaway the internal detail of the mattress.

In FIG. 1, a waterbed 10 of the present invention, comprises a frame 12 and a mattress 14. The mattress includes a top panel 16, side panels 18 and a bottom panel 20 joined at upper edges 22 and bottom edges 24. As is generally the case, the mattress 14 is fabricated of a pliant vinyl plastic or like imperforate flexible material.

Internal of the waterbed mattress 14 is a supplemental panel or membrane 26 which spans between the side panel 18 and the top panel 16 along seams 28 and 30 generally parallel to the edge 22 separating the interior into a supplemental or corner chamber 32 and a main chamber 34.

Figure 2:
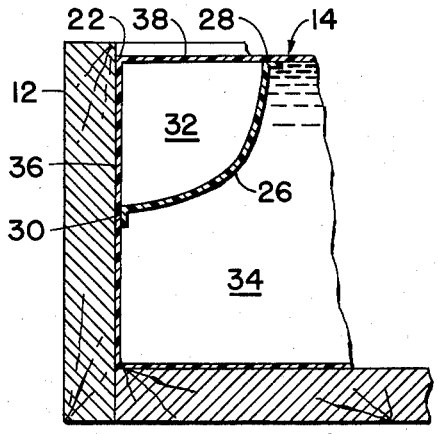
FIG. 2 is a cross sectional view of the perimeter of the mattress showing a first preferred embodiment of the corner chamber.

Referring particularly to FIG. 2, it is seen that the membrane 26, a side panel segment 36 and a top panel segment 38 together constitute the supplmental or corner chamber 32. The corner chamber 32 is sealed from the main chamber 34 along seams 28 and 30. The corner chamber 32 may be continuous along edge 22 around the mattress periphery, ot it may be subdivided into isolated longitudinally spaced chamber sections along the edges 22.

In the embodiment of FIG. 2, corner chamber 32 is shown to be substantially inflated. Chamber 32 may be filled with any fluid including air, and is generally inflated to a greater degree than the main chamber 34. The cross-sectional length of membrane 26 is not greater than the total cross-sectional length of segments 36 and 38 from seam 30 to edge 22 and thence to seam 28. The length of the segment 36 between edge 22 and seam 30 may be approximately equal to the length of the segment 38 between edge 22 and seam 28.

Figure 3:
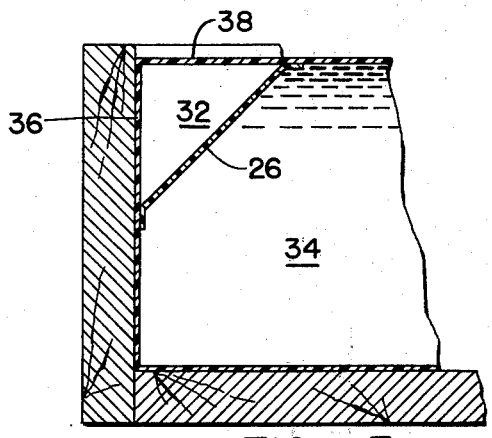
FIG. 3 is a cross sectional view of the mattress showing a second preferred embodiment of the corner chamber.

In FIG. 3, a further specific embodiment of the invention is shown. Therein the corner chamber 32 is formed by membrane 26 which together with segments 36 and 38 generally establish in cross section a right triangle, when the corner chamber 32 is suitably inflated. The membrane 26 in cross section is the hypotenuse of the triangle.

Figure 4:
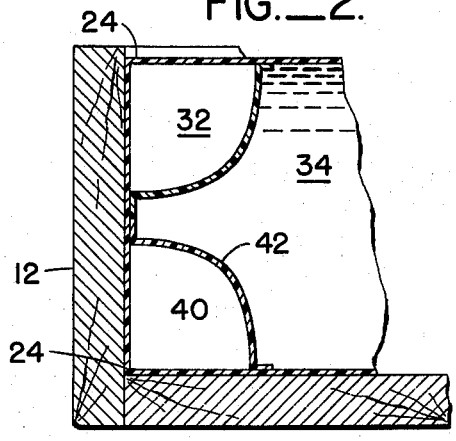
FIG. 4 shows in cross section a further preferred embodiment of the perimeter of a waterbed mattress.

In FIG. 4, a still further embodiment of the invention is shown. The mattress 14 includes a first corner chamber 32 formed by a membrane 26 spanning the upper edge 22 and a second corner chamber 40 formed by a membrane 42 spanning the lower edge 24. Each of the chambers (main chamber 34, first corner chamber 32 and second corner chamber 34) is separated and individually inflatable to a desired pressure or rigidity.

It is readily understood that the function of the corner chambers 32 and 40 is to provide rigid fluid support for the upper and lower edges of the mattress 14 separate from the main chamber 34 without substantial alteration to the mattress's characteristic softness and conformability to a supported body near the mattress center. The first corner chamber 32 and second corner chamber 40 are inflatable to a selected level to provide relatively rigid peripheral support along the side panels 18. The pressure in corner chambers 32 and 40 counteract localized pressure which could cause depression of the mattress 14 at the frame abutting edges. This risk of accidentally slipping between the mattress 14 and the frame 12 is thus minimized. In addition, chamber 32 in the upper corner benefits from additional buoyancy when filled with a fluid less dense than the liquid in main chamber 34. Such buoyance tends to lift edge 22 and to press segment 36 firmly against the inside of frame 12.

In the embodiment of FIG. 4, the second corner chamber 40, when suitably inflated, maintains the lower edge 24 firmly against the frame 12. Moreover, second corner chamber 40 becomes at least partially supportive of first corner chamber 32 when under localized loading which presses downwardly on the upper corner chamber 32, the chambers 32 and 40 encounter one another within the mattress 14.

The waterbed mattress according to this construction is easily and economically fabricated and provides the particular advantages hereinabove indicated. Other embodiments and modifications will be obvious to those of ordinary skill in this art upon reference to the present invention specification. Therefore it is not intended that the invention be limited except as indicated by the appended claims.

I claim:

1. In a waterbed mattress including a bladder formed of pliant sheet material defining a top panel, a bottom panel, and side panels joining said top and bottom panels at upper peripheral margins and lower peripheral margins respectively, said side panels being adapted to conform to a rigid, circumscribing peripheral framework preventing lateral distortion thereof, the improvement comprising: at least one supplemental panel of a pliant sheet material which internally spans said upper peripheral margins, sealably separating said bladder into a main chamber for containing a liquid and at least one upper corner chamber for containing a selected fluid, the spanning dimension of said supplemental panel approximating the length of the hypotenuse of a triangle whose legs are formed by the portions of said top panel and said adjacent side panel forming said upper corner chamber whereby said at least one upper corner chamber establishes the structural rigidity of said upper peripheral margins.

2. The improvement according to claim 1, wherein said bladder defines a generally rectangular cross section, and wherein the surface dimension along a cross section of said top panel and the adjacent side panel from the junctions of the abutting supplemental panel to the intermediate peripheral margin is at least as great as the internal spanning dimension of the said supplemental panel.

3. The improvement according to claim 2, wherein said at least one upper corner chamber is adapted to contain a buoyant fluid sealably separated from said main chamber.

4. An improvement according to claim 3, wherein said at least one upper corner chamber is adapted to contain a pressurized gas.

5. A waterbed comprising:

a water-containing mattress;

a rigid peripheral framework for preventing lateral distortion of said mattress;

said mattress including a bladder formed of vinyl sheet material having top and bottom panels and side panels, said side panels sealably joining said top and bottom panels along upper edges and lower edges a first supplemental panel formed of vinyl sheet material internally peripherally spanning the upper corner to sealably separate said bladder into a main chamber for containing a supportive liquid and an upper corner chamber;

a second supplemental panel formed of vinyl sheet material, internally spanning the lower corner portion sealably separating from said main chamber a lower corner chamber, said upper and lower corner chambers being inflatable with a fluid for providing structural rigidity to said mattress along the peripheral framework.

6. A waterbed according to claim 5, wherein the cross sectional dimension of said first supplemental panel internally spanning said top panel and said side panel does not exceed the length of the cross sectional dimensions of said top panel and said side panel forming said upper corner chamber.

7. A waterbed according to claim 6, wherein the cross sectional dimension of the side panel portion forming the upper corner chamber is approximately equal to the cross sectional dimension of the top panel portion of the upper corner chamber.

8. A waterbed comprising:

a water-containing mattress;

a rigid peripheral framework for preventing lateral distortion of said mattress;

said mattress including a bladder formed of vinyl sheet material having generally rectangular top and bottom panels and side panels, said side panels sealably joining said top and bottom panels along upper edges and lower edges, said bladder defining a generally rectangular cross section;

a first supplemental panel formed of vinyl sheet material having one margin sealably disposed parallel to said upper edge along the inside of said upper panel and an opposing parallel margin sealably disposed parallel to said upper edge along the inside of said side panel for sealably separating said bladder into a main chamber for containing a supportive liquid and an upper corner chamber wherein the cross-sectional dimension of said first supplemental panel does not exceed the length of the cross sectional dimensions of the portion of said top panel and said side panel forming said upper corner chamber;

a second supplemental panel internally spanning the lower corner sealably separating the main chamber from a lower corner chamber, said upper and lower corner chambers being inflatable with a fluid for providing structural rigidity to said mattress along the peripheral framework.

* * * * *